United States Patent [19]

Knight

[11] Patent Number: 4,790,051

[45] Date of Patent: Dec. 13, 1988

[54] ODOR-PROOF DISASTER POUCH

[76] Inventor: Robert L. Knight, 4959 Platt Springs Rd., West Columbia, S.C. 29169

[21] Appl. No.: 91,450

[22] Filed: Aug. 31, 1987

[51] Int. Cl.[4] ..... A61G 1/00

[52] U.S. Cl. ..... 27/28; 383/61

[58] Field of Search ..... 27/2, 19, 28; 190/110, 190/124, 111, 112, 113, 125; 224/157, 158; 383/61, 97, 63

[56] References Cited

U.S. PATENT DOCUMENTS

| | | | |
|---|---|---|---|
| 39,291 | 7/1863 | Holmes | 27/11 |
| 685,789 | 11/1901 | McKendrick | 383/10 |
| 924,029 | 6/1909 | Barnes | 27/2 |
| 2,170,379 | 8/1939 | Ortt | 119/19 |
| 2,613,421 | 10/1952 | Masden | 24/399 |
| 2,626,689 | 1/1953 | Davis et al. | 190/113 |
| 3,122,807 | 3/1964 | Ausnit | 24/399 |
| 3,175,658 | 3/1965 | Bierman | 190/113 X |
| 3,301,452 | 1/1967 | Jester | 229/52 R |
| 3,606,137 | 9/1971 | Kugler | 383/31 |
| 3,861,504 | 1/1975 | McGraw | 190/113 X |
| 4,268,938 | 5/1981 | Walchli | 53/334 |
| 4,301,791 | 11/1981 | Franco | 128/89 R |
| 4,637,063 | 1/1987 | Sullivan et al. | 383/61 |

FOREIGN PATENT DOCUMENTS

| | | | |
|---|---|---|---|
| 756492 | 9/1956 | United Kingdom | 27/28 U X |
| 2115690A | 9/1983 | United Kingdom | 383/6 |

*Primary Examiner*—Robert A. Hafer
*Assistant Examiner*—Samuel Rimell
*Attorney, Agent, or Firm*—Benoni O. Reynolds

[57] ABSTRACT

A strong, flexible, waterproof, odorproof pouch for transporting dead human bodies comprising an outer envelope that encases and is sealed at the outer edges to a transparent inner liner within which is placed the body or bodies to be moved. The outer envelope has a primary panel and the inner liner has a complementing secondary panel for gaining access to the interior of the inner liner to place or examine the remains therein. The primary panel is sealable using a heavy duty, zipper-type, slide fastener, to handle the weight and stresses of movement and the secondary panel is sealable against the odors and fluids of decomposition using a rib-and-groove, zip-lock type fastener. The outer envelope is supported and carried by two or more lengthwise straps and two or more widthwise straps attached to the underside of the outer envelope, which straps have extensions looped at their ends to form handholds.

7 Claims, 2 Drawing Sheets

ODOR-PROOF DISASTER POUCH

BACKGROUND OF THE INVENTION (1) Field of Invention:

The present invention relates to the art of body bags or pouches for transporting and storing dead human bodies. More particularly the invention is concerned with strong, flexible, waterproof, odorproof pouches for use in transporting and storing such bodies following an accident, a crime or under circumstances where the potential for a delay between death and cremation or burial of the body may allow substantial decomposition of body tissue to take place.

(2) Description of the Prior Art:

Following death, a human body begins to decompose. The products of such decomposition, body fluids and gases, are both disagreeable and may contain harmful organisms. If there is a delay between death and cremation or burial of the body, these products can build to levels that are barely tolerable to those persons whose job it is to recover, transport, examine, or dispose of human remains. Also, these decomposition products constitute an immediate health problem to these people. Such a delay may occur following a disaster or accident, where one or more persons has died in a remote area or in such numbers as to overwhelm the facilities available for temporarily holding human remains or where substantial decay of human tissue can occur during the time required to find and recover a body. In the event a crime is suspected of having been committed, the investigation of criminal allegations may include examination of the remains of the victim. Storage of these remains may be necessary until appropriate examiners can be convocated and allowed access to the body. Also, following a severe traffic accident, there may be need for a pouch to transport those remains badly mangled.

Relatively little progress has been made in the art of pouches for dead human bodies despite the evolution of technology generally. U.S. Pat. No. 39,261 issued to Holmes in July 1863 and U.S. Pat. No. 924,029 issued to Barnes in June of 1909 disclose pouches for dead human bodies. The invention of Holmes is a single India Rubber bag wherein a body is placed and the bag tied by a cord around the neck of the bag into which neck a wooden stopper has been fitted for a tight seal.

The pouch of Barnes for transporting dead human bodies is also preferably made of India Rubber. Barnes, however, has a series of three layers wrapped and buttoned to hold the body and to make the pouch "airtight".

The conventional pouch used today is a simple vinyl bag having a single panel cut into one side which panel may be opened for placing a body therein or for gaining access to the body for examination. It is closed and sealed temporarily with a zipper-type slide fastener. The pouch has multiple wooden dowels encased in the periphery of the bag and parallel thereto, adjacent to a number of cut out portions, whereby a hand can be inserted through the cut out portion, to grip the dowel and lift the pouch. The present pouches tend to leak and are not odorproof, deficiencies which are overcome for the first time by the present invention.

Not only does the present invention meets its major objective of being odorproof, it is waterproof, easy to open and close, requires no special tools durable and easily handled by disaster personnel. Prior art known to this inventor includes the following U.S. Pat. Nos:

| | | |
|---|---|---|
| 39,291 | 7/1863 | Holmes |
| 924,029 | 6/1909 | Barnes |
| 685,789 | 11/1901 | McKendrick |
| 2,170,379 | 8/1939 | Ortt |
| 2,613,421 | 10/1952 | Madsen |
| 2,626,689 | 1/1953 | Davis et al. |
| 3,122,807 | 3/1964 | Ausnit |
| 3,301,452 | 1/1967 | Jester |
| 3,606,137 | 9/1971 | Kugler |
| 4,268,938 | 5/1981 | Walchli |
| 4,301,791 | 11/1981 | Franco, III |
| 4,637,063 | 1/1987 | Sullivan et al. |

BRIEF SUMMARY OF THE INVENTION

The present invention is a pouch for transporting and storing dead human bodies. To encase the body, the pouch has an outer envelope and an inner liner which are constructed of strong, flexible, waterproof, odorproof material such as vinyl. The outer envelope has an openable primary panel on one side of the outer envelope and an outer sealing means to secure temporarily the closure of the primary panel of the outer envelope. The inner liner lies within the outer envelope, the outer edges of the inner liner being sealed to the outer edges of the outer envelope. The inner liner has an openable secondary panel on the same side of the inner liner as the openable primary panel of the outer envelope and an inner sealing means to secure temporarily the closure of the secondary panel of the inner liner.

The outer sealing means, to open and close the outer envelope, is a heavy duty, zipper-type, slide fastener and a course along which the zipper-type slide fastener travels. This slide fastener provides strength to the pouch and counteracts stresses that might be caused by movement of the body within the pouch during transport.

The inner liner is transparent for ease of viewing and identifying a body or bodies being transported or stored. The transparency feature of the inner liner is also useful in detecting the accumulation of gases or fluids which should be expelled. The inner sealing means, for opening and closing said inner liner, is a rib-and-groove, zip-lock type fastener and a course along which the zip-lock type fastener travels. This zip-lock type fastener renders the inner liner both waterproof and odorproof.

The pouch of the present invention has a reinforcement means, underlaying and attached to the underside of the outer envelope, for supporting the pouch. Reinforcement means is two or more straps oriented lengthwise to the pouch and two or more straps oriented widthwise to the pouch, the straps extending beyond the outer edges of the outer envelope. This network of straps, underlying the pouch, run lengthwise and widthwise to add strength and maintain the geometry of the loaded pouch.

The pouch also has a grippable means, attached to the outer envelope, for lifting and carrying said pouch. Grippable means is the extensions of the straps of the reenforcement means beyond the outer edges of the outer envelope, the extensions each being looped back onto their respective strap and secured thereto, to form handles.

OBJECTIVES OF THE INVENTION

The objectives of the present invention are to provide a pouch for transporting and storing dead human bodies which pouch is:

(1) odorproof;

(2) waterproof, permitting no products of the decomposition of human tissue to escape;

(3) quick to open and close, reducing the time required to seal in the remains;

(4) easily opened and closed, requiring no special tools, expertise or skill to effectively seal in the remains;

(5) transparent in some respects for viewing and identifying the contents without disturbing them;

(6) easily checked for the accumulation of gases or body fluids which should be expelled;

(7) durable in construction to safely handle the weight and stresses of a dead human body or its parts during transport;

(8) easily lifted and carried, under loaded conditions, by two or more disaster personnel, to facilitate the rapid recovery of human remains without danger to such personnel.

Other objectives and advantages will be apparent during the course of the following detailed description

DETAILED DESCRIPTION OF THE PREFERRED EMBODIMENT OF THE INVENTION

Figure 1:
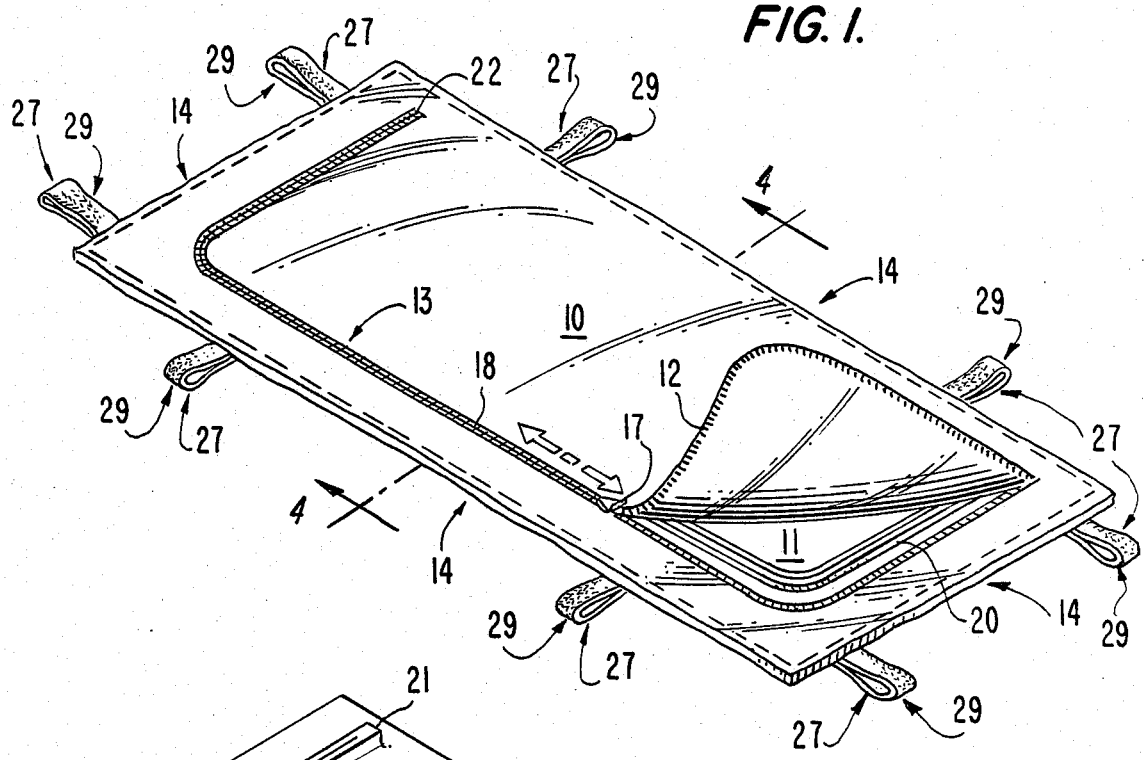
FIG. 1 is a perspective view, from the left front, of the Odor-Proof Disaster Pouch, constructed in accordance with the principles of the present invention, showing the top of the outer envelope of the pouch and primary panel with the corner of the primary panel opened to show a portion of the inner liner with its secondary panel. fastener of the outer envelope, indicate the direction of travel along the fastener's course, parallel and along three edges of the pouch. The fastener is moved to the left to open the primary panel and is moved to the right to close the primary panel. Eight looped shaped extensions are shown around the periphery of the bag, two extensions on each of the four edges of the pouch.

The odor-proof disaster pouch of the present invention is a container for transporting and storing a dead human body. The pouch encases the body in two completely surrounding layers of a strong, flexible, waterproof and odor-proof material which temporarily seal the remains during removal from the disaster site. Throughout the following detailed description of the present invention like reference numerals are used to denote like parts disclosed in the accompanying drawings, FIGS. 1–4.

Figure 2:
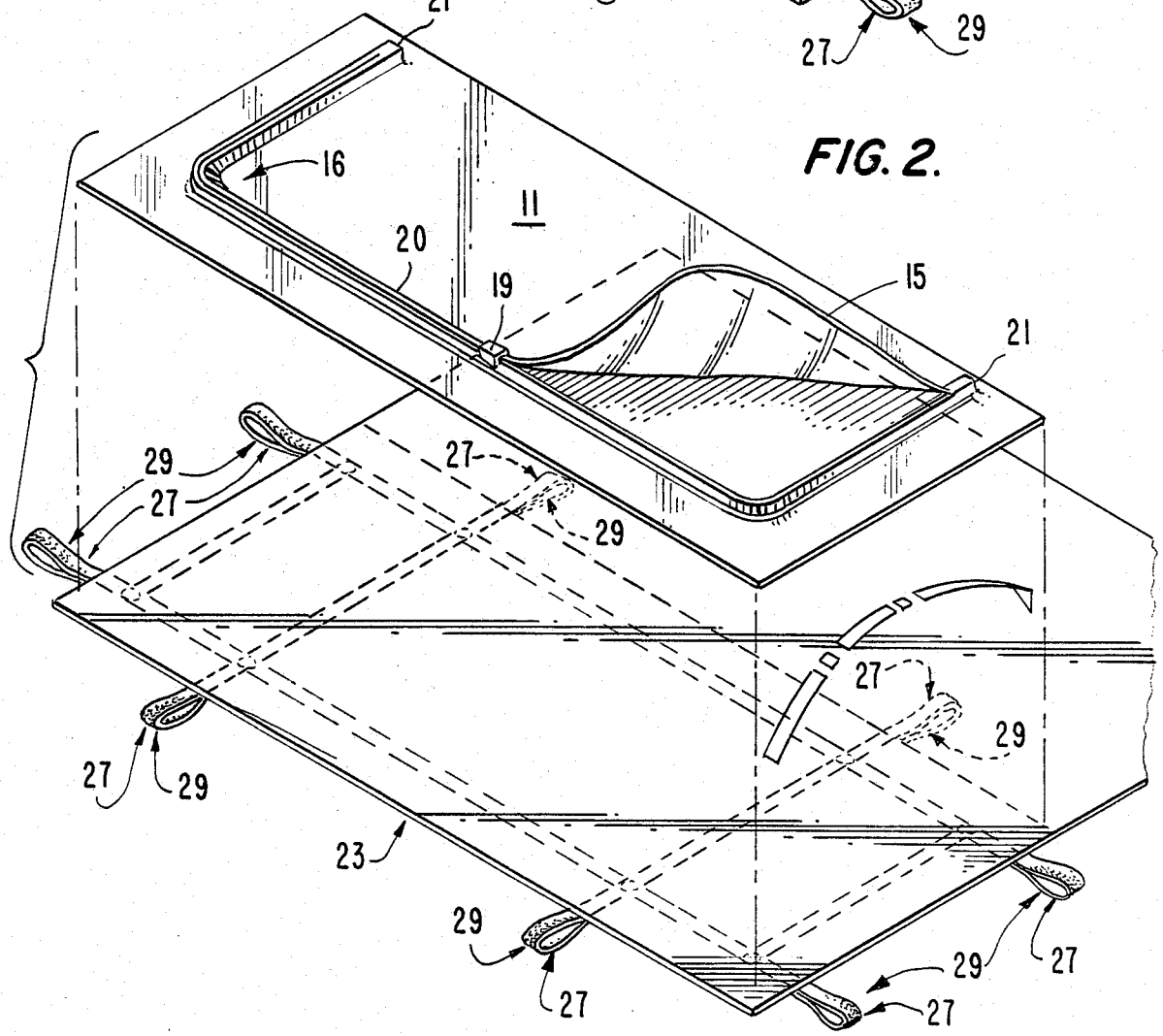
FIG. 2 is an exploded perspective view of the present invention oriented in the same way as the pouch in FIG. 1. The top of the outer envelope has been pulled away to the right and the top of the inner liner raised to reveal the interior of the inner liner therebelow. The secondary panel of the inner liner, with its zip-lock type fastener, is partly opened. The course of the zip-lock type fastener is shown to be parallel to the same three edges of the bag as the course of the zipper-type slide fastener of the outer envelope.

As shown in FIGS. 1 and 2, the odor-proof disaster pouch comprises an outer envelope, shown generally at reference numeral 10 and an inner liner, shown generally at reference numeral 11. Outer envelope 10 provides a strong, flexible exterior support to counteract any stresses arising to the pouch during movement of the assembly while fully loaded. Outer envelope 10 fully encloses inner liner 11 and has an openable primary panel 12 on one side of outer envelope 10. Also, outer envelope 10 has an outer sealing means, shown generally at reference numeral 13, to secure temporarily the closure of primary panel 12 of outer envelope 10.

Figure 4:
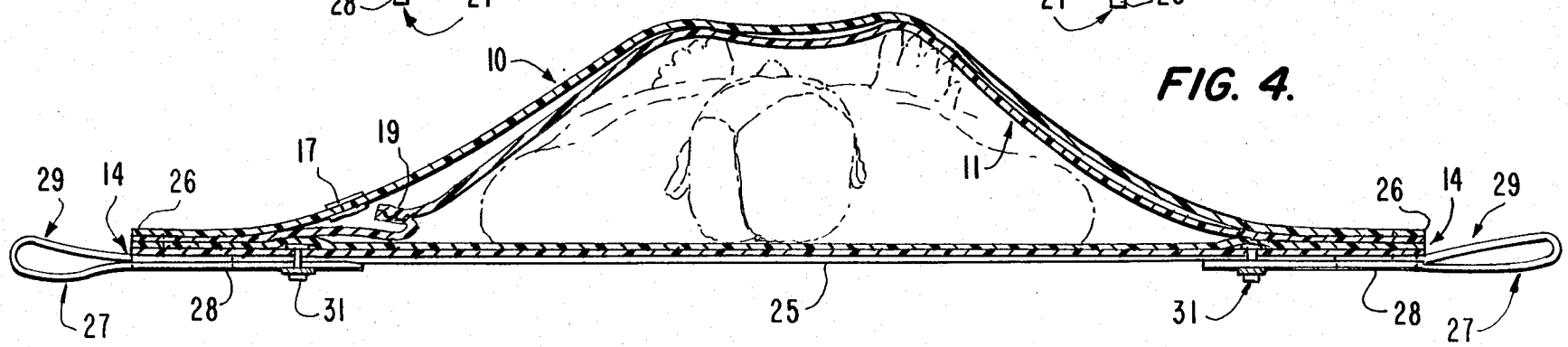
FIG. 4 is a cross-sectional view along line 4—4 of FIG. 1 as seen in the direction of the arrows. A cross-section of the top and bottom of the outer envelope is shown as well as a cross-section of the top and bottom of the inner liner. The outer edges of the outer envelope and the inner liner are shown meeting at the periphery of the pouch where the edges are heat sealed to each other. The zipper-type slide fastener is shown on the left side of the top of the outer envelope. The zip-lock type fastener is shown on the left side of the top of the inner liner. In particular, it is shown that the zip-lock is formed by raising and extending the edges of the inner liner and the secondary panel so that their interior surfaces face one another. The ribs and grooves of the zip-lock are on these interior surfaces; the zip-lock type fastener straddles the edges of the meeting interior surfaces of the inner liner and alternately seals or unseals the secondary panel as it interleaves or separates the zip-lock ribs and grooves, respectively, depending on the direction in which the zip-lock type fastener travels along its course.

As shown in FIGS. 1 and 4, inner liner 11 lies completely within outer envelope 10. As shown generally at reference numeral 14, the outer edges of inner liner 11 are sealed, preferably by heat sealing, to the outer edges of outer envelope 10. The peripheral edges of outer envelope 10 and inner liner 11 are fused by heat to each other to assure a waterproof and odor-proof seal about the entire periphery of the pouch and to maintain the orientation of inner liner 11 with respect to outer envelope 10. Also, as shown in FIG. 2, inner liner 11 has an openable secondary panel 15 on the same side of inner liner 11 as openable primary panel 12 of outer envelope 10. An inner sealing means, shown generally at reference numeral 16, is provided in the top of inner liner 11 to secure temporarily the closure of secondary panel 15 of inner liner 11.

Both outer envelope 10 and inner liner 11 are preferably constructed of strong, flexible, waterproof, odor-proof material such as vinyl. Normally both outer envelope 10 and inner liner 11 are rectangular in shape and have sufficient external and internal dimensions to accommodate easily the placement of a large human body therein. Preferably, inner liner 11 is transparent for ease of viewing and identifying a body or bodies being transported or stored. The use of a transparent form of pouch material facilitates such visual examination or identification of the body without the need to open the waterproof, odor-proof inner liner 11. Body bags of the prior art did not permit such examination or identification without the release of undesirable odors or gases.

Access to the interior of the pouch is obtained by opening the two door-like panels, primary panel 12, in the top surface of outer envelope 10, and secondary panel 15 in the top surface of inner liner 11. Primary panel 12 opens by unsealing outer sealing means 13 and then lifting primary panel 12 up and to the side. Similarly, secondary panel 15 opens by unsealing inner sealing means 16 and then lifting secondary panel 15 up and to the side.

Outer sealing means 13, to open and close outer envelope 10, is a heavy duty, zipper-type, slide fastener 17 and a course 18 along which zipper-type slide fastener 17 travels to join the zippered edges of primary panel 12 to the balance of the surface of outer envelope 10 of which it is a part. Inner sealing means 16, for opening and closing inner liner 12, is a rib-and-groove, zip-lock type fastener 19 and a course 20 along which zip-lock type fastener 19 travels to join the ribbed and grooved edges of secondary panel 15 to the balance of the surface of inner liner 11 of which it is a part. Course 18 and course 20 are parallel to three sides of the pouch with course 20 of inner liner 11 located a slightly greater margin from the pouch periphery than course 18 of outer envelope 10.

Outer sealing means 13 uses heavy duty, zipper-type slide fastener 17 and course 18 as a seal for greater strength to counteract the stresses which may arise during the movement of the loaded pouch. Inner sealing means 16 uses rib-and-groove, zip-lock type fastener 19 and course 20 as a seal to achieve a completely waterproof and airproof seal of inner liner 11. Inner liner 11 is closed by pressing the raised and extended edges of the interior surface of secondary panel 15 and of the balance of the interior surface of inner liner 11 together in order that the ribs and grooves of inner sealing means 16, formed at the edges of these interior surfaces, may interleave. Zip-lock type fastener 19 straddles the edges of inner liner 11 and secondary panel 15 to alternately interleave or separate the zip-lock ribs and grooves. At the both ends of course 20 traveled by zip-lock type fastener 19 are short "runoff" tabs 21, extending beyond the opening defined by secondary panel 15, for zip-lock type fastener 19 to travel past this opening and thereby completely seal inner liner 11. Outer envelope 10 is closed simply by moving zipper-type slide fastener 17 left to right along course 18 to stop 22. As the waterproof and airproof functions are carried out by inner sealing means 16, outer sealing means 13 need only carry out the security and strength needs of the pouch and thereby protect the integrity of inner liner 11 and its contents.

Figure 3:
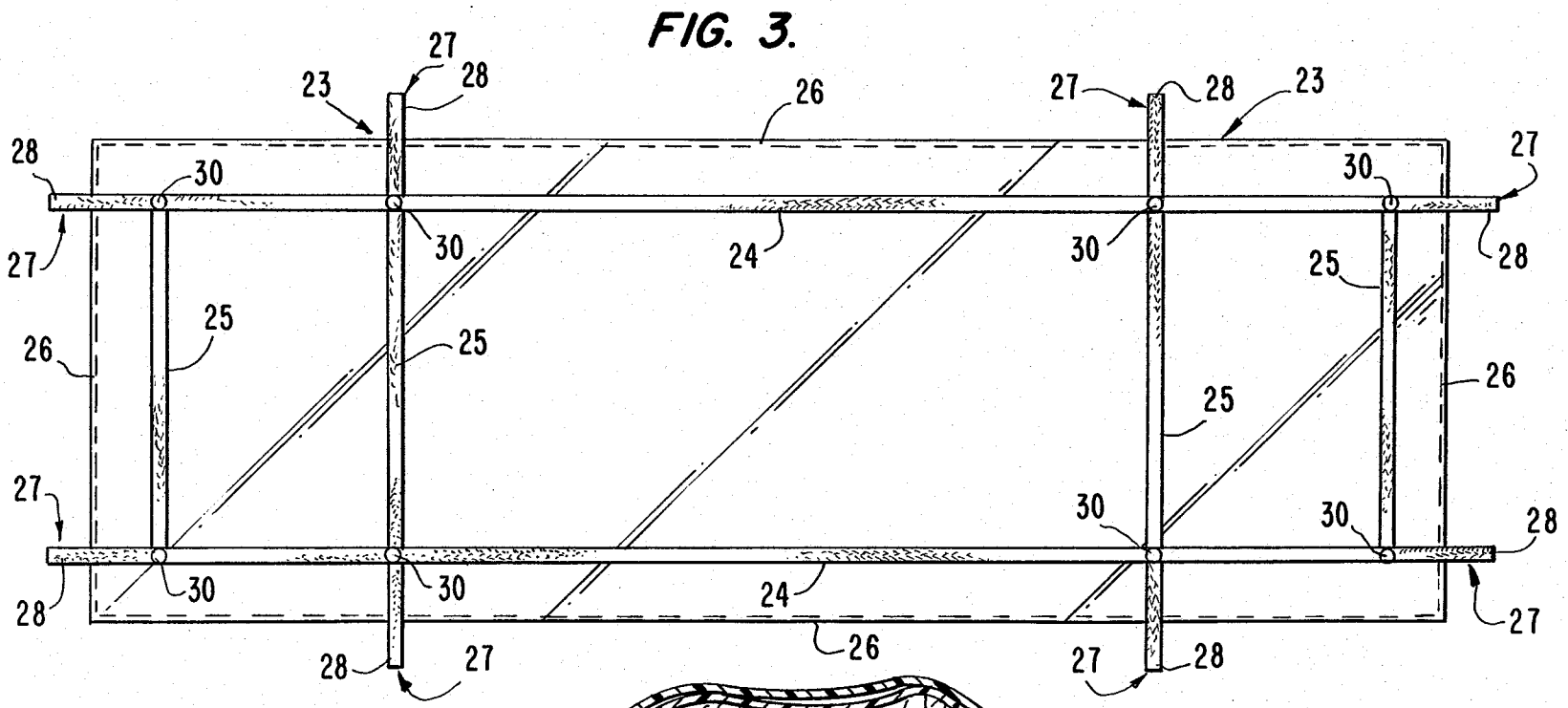
FIG. 3 is a bottom plan view of the present invention showing the network of straps making up the reenforcement means. There are two straps oriented lengthwise and four straps oriented widthwise, meeting at right angles with respect to one another. The lengthwise straps and two of the widthwise straps are shown extended beyond the periphery of the pouch with the extensions looped back on themselves to make up the grippable means for lifting and carrying the bag.

Underlaying and attached to the underside of outer envelope 10 are reinforcement means, shown generally at reference numeral 23, for, supporting the pouch. As best shown in FIG. 3, reinforcement means 23 is two or more straps 24 oriented lengthwise to the pouch and two or more straps 25 oriented widthwise to the pouch, the straps extending beyond outer edges 26 of outer envelope 10. Straps 24 and 25 are preferably made of a flexible, but more geometrically stable, material than the pouch material, such as nylon webbing. Straps 24 run lengthwise and straps 25 run widthwise along the pouch at intervals sufficient to provide support to the pouch at points apt to be subject to stress. Preferably two lengthwise straps 24 and four widthwise straps 25 of one-inch nylon webbing, meeting at right angles with respect to each other and sewed to the bottom of the pouch are sufficient.

As the present invention is designed to be handcarried when necessary, grippable means, shown generally at reference numeral 27, is attached to outer envelope 10, for lifting and carrying the pouch. As best shown in FIG. 4, grippable means is extensions 28 of straps 24 and 25, beyond outer edges 26 of outer envelope 10, extensions 28 each being looped back onto their respective straps 24 and 25 and secured thereto, to form handles, shown generally at reference numeral 29. Preferably, handles 29 are formed by extending reenforcing straps 24 and 25 beyond the periphery of the pouch, looping each strap 24 or 25 back under itself as shown in FIG. 4, and attaching the running ends of straps 24 and 25 to the underside of the pouch. Where straps 24 and 25 cross and where the running ends of extensions 28 are joined to the pouch at points 30, a fastening device 31, such as a rivet or bolt, is passed through the layers of straps 24 or 25 and the bottom of outer envelope 10 but not through the bottom of inner liner 11.

The above described construction of the present invention provides all the desirable features needed for a strong, flexible, waterproof and ordor-proof disaster pouch not found in the prior art. Also, the construction permits various degrees of access to the contents therein for viewing or identification of the contents without the release of objectionable odors, gases or fluids.

I claim:

1. A pouch, for transporting and storing a dead human body or bodies, comprising:

an outer envelope having an openable primary panel on one side of said outer envelope, and an outer sealing means to secure temporarily the closure of said primary panel of said outer envelope, and an inner liner within said outer envelope whose outer edges are sealed to the outer edges of said outer envelope, which inner liner has an openable secondary panel on the same side of said pouch as the said openable primary panel, and an inner sealing means to secure temporarily the closure of said secondary panel of said inner liner, and reinforcement means underlaying and attached to the underside of said outer envelope for supporting said pouch, and grippable means attached to said outer envelope for lifting and carrying said pouch.

2. The pouch of claim 1 wherein said outer envelope and said inner liner are constructed of strong, flexible, waterproof, odorproof material such as vinyl.

3. The pouch of claim 1 wherein said outer sealing means to open and close said outer envelope is a heavy duty, zipper-type, slide fastener and a course along which said zipper-type, slide fastener travels.

4. The pouch of claim 1 wherein said inner liner is transparent for ease of viewing and identifying said body or bodies being transported or stored.

5. The pouch of claim 1 wherein said inner sealing means for opening and closing said inner liner is a rib-and-groove, zip-lock type fastener and a course along which said zip-lock type fastener travels.

6. The pouch of claim 1 wherein said reinforcement means is two or more straps oriented lengthwise to said pouch and two or more straps oriented widthwise to said pouch, said straps extending beyond said outer edges of said outer envelope.

7. The pouch of claim 1 wherein said grippable means is the extensions of said straps beyond said outer edges of said outer envelope, said extension each being looped back onto their respective strap and secured thereto, to form handles.

* * * * *